United States Patent [19]

Paschen et al.

[11] 4,344,773

[45] Aug. 17, 1982

[54] APPARATUS FOR THE GASIFICATION OF CARBON AND/OR CARBON-CONTAINING MEDIA

[75] Inventors: Peter Paschen, Bergisch Gladbach; Roland Pfeiffer, Cologne; Heinz-Dieter Waldhecker, Bergisch Gladbach; Alfred Kryczun; Rolf Pufal, both of Cologne, all of Fed. Rep. of Germany

[73] Assignee: Klöckner-Humboldt-Deutz AG, Fed. Rep. of Germany

[21] Appl. No.: 217,816

[22] Filed: Dec. 18, 1980

[30] Foreign Application Priority Data

Dec. 18, 1979 [DE] Fed. Rep. of Germany ..... 2950865

[51] Int. Cl.[3] ..... C10J 3/20

[52] U.S. Cl. ..... 48/92; 48/89; 48/93; 48/94; 202/219

[58] Field of Search ..... 48/89, 92, 93, 94; 202/219

[56] References Cited

U.S. PATENT DOCUMENTS 3,690,808 9/1972 St. Pierre ..... 48/92 X 4,062,657 12/1977 Knüppel et al. ..... 48/92 X

*Primary Examiner*—Arthur D. Kellogg

*Attorney, Agent, or Firm*—Hill, Van Santen, Steadman, Chiara & Simpson

[57] ABSTRACT

In a device for the gasification of carbon and/or carbon-containing media, in particular for the continuous production of a gas essentially containing CO and $H_2$ with a molten bath of iron or an iron alloy, a reactor receives the carbon-containing media and oxidizing gasification media under the surface of the molten bath, and outlets are provided for gas and for removing at least one liquid phase, in particular slag. The reactor is stationary and is tightly sealed to a gas outlet and to a liquid outlet. In a wall region of the reactor and close to the floor thereof a plurality of nozzles are provided for feeding the gasification media. The nozzles are distributed almost symmetrically with respect to a vertical plane which extends axially with respect to the liquid outlet and to the reactor floor about the circumference of the wall region.

11 Claims, 3 Drawing Figures

APPARATUS FOR THE GASIFICATION OF CARBON AND/OR CARBON-CONTAINING MEDIA

BACKGROUND OF THE INVENTION

1. Field of the Invention

The invention concerns a device for the gasification of carbon and/or carbon-containing media, in particular for the continuous production of a gas essentially containing CO and $H_2$ by a metal-containing molten bath, in particular an iron or iron alloy-containing molten bath consisting of a reactor to which both carbon-containing and oxidizing gasification media are supplied underneath the surface of the molten bath, and which is provided with openings both for the connection of at least one gas outlet conduit and for the connection of at least one outlet organ for at least one liquid phase.

2. Description of the Prior Art

In the case of known devices for the gasification of carbon and/or carbon-containing media for the production of a CO and $H_2$-containing reaction gas, as for example can be taken from the German Pat. No. 1,915,248, sulfer-containing carbon fuel (coal fuel) and preheated air are introduced laterally by lances which extend through the walls of a stationary reactor, into an iron-containing metal bath.

SUMMARY OF THE INVENTION

The problem of the present invention consists in further developing the known device according to the German Pat. No. 1,915,248.

The solution of the problem succeeds in that the reactor displays the following features:

- the reactor is stationarily arranged and is connected tightly both to a gas outlet conduit and at least to one outlet organ for a liquid phase,
- in a wall region of the reactor which is close to the floor nozzles are arranged for the feeding of gasification media,
- the nozzles are distributed on the circumference of the wall region almost symmetrically with respect to a vertical plane extending almost centrally (axially) both to the outlet organ for a liquid phase and to the reactor floor.

With the invention, there results a reactor having a very compact structure which, because of the stationary arrangement, is particularly suitable for operation under pressure.

By the special arrangement of the nozzles, a symmetrical relatively quiet flow is brought about in the molten bath, by which, in particular, the stability of the incombustible lining is significantly improved with respect to corrosion and wear.

In design of the invention, it is provided that the wall region which accepts the nozzles displays an angle $\alpha_1$ with respect to a vertical plane. In this manner, in the molten bath between floor and wall region, favorable flow passages arise, which in an advantageous manner bring about an additional protection of the incombustible lining in the reactor.

In a further design it is provided that the nozzles, as viewed in the blowing direction, are arranged with respect to a horizontal plane at an angle $\alpha_2$ with a downwardly directed slope. Hereby it is attained, in an advantageous manner, that at the end of the nozzle, a downwardly directed parallel flow is generated which protects this against overheating by the focal spot which arises with the reaction of the gasification media and the fuel with the molten bath, in that this focal spot is deflected by the parallel flow from the end of the nozzle and is drawn deeper into the molten bath.

In a further design it is provided that the dimensions of the molten bath are designed such that the metal displays a volume/surface ratio between 1 $m^3$:1.5 $m^2$ to 2.5 $m^2$, and preferably between 1 $m^3$:1.8 $m^2$ to 2.2 $m^2$.

Hereby, in an advantageous manner, on the one hand there results a sufficient bath depth which is necessary in order to prevent the blowing of the gasification medium and/or the slag-forming constituent through the liquid metal, and on the other hand, for a favorable exit velocity for the gas which arises, whereby an attempt is made to keep this exit velocity as low as possible, in order, with avoidance of strong boiling in the molten bath, to attain an undisturbed blowing behavior, which simultaneously has the effect that the dust content in the product gas is as low as possible.

It is provided in a further design that for each approximately 0.5 $m^3$ of volume of the metal, preferably one nozzle is provided. This design also has the advantageous effect that damaging volume arrangements are avoided in the convective bath movement. Besides this, the gasification media, as a result of multiple distribution onto the total bath volume, obtains sufficient possibility for homogeneous mixture and thus for complete reaction.

In a further development it is provided that on the wall region of the reactor which is close to the floor, the nozzles are arranged in approximately the same spacing with respect to one another, whereby the nozzles which are arranged closest to the slag outlet preferably form, between one another, an angle of at least 90°. This arrangement provides the advantage that a uniform and quiet flow formation, which is symmetrical to the direction of the slag outlet, is attained in the molten bath, which is important for an optimum separation of the slag from the metal, in particular for avoiding metal losses during the discharge of the slag.

Besides this, the designs in the mutual, favorable cooperation produce as total effect a protective stressing of the incombustible lining in the reactor, optimum flow relationships in the convective system of the molten bath, and an optimum distribution of the substances fed into the metal, which favors the reaction between fuel, gasification media and the metal bath.

It is provided in a further design that the nozzle end pieces are arranged approximately 250 mm under the surface of the liquid metal and that this depth of emersion corresponds to approximately equal distance of the nozzle end piece from the reactor floor. Hereby, it is attained in an advantageous manner that on the one hand, for the reactor there is a sufficient reaction span and thus reaction time in the molten bath, which prevents a blow through of the gasification media or the slag forming constituents, and that on the other hand, the bath convection arising during the gasification in the vicinity of the floor is already so greatly attenuated that a damaging of the reactor floor, or respectively, of the incombustible lining, is prevented.

It is further provided that in the region of the floor, an emergency tap is provided for the molten bath. This emergency tap in the case of the stationary reactor permits the drainage of the liquid melt phases, in the case that for operational-technical reasons, for example in the case of an interference, shutdown of the gasification device should become urgently necessary.

In a further design it is provided that the reactor above the molten bath displays a gas quieting chamber which is enlarged in its cross section in relationship to the bath surface. This design has the advantage that the dust content of the product gas is kept as small as possible and that, in particular, the carrying along of slag and metal particles is prevented.

In a further design it is provided that the gas chamber of the reactor is tightly closed with a cover which is preferably dismantlable, in which are arranged the gas outlet opening and, where applicable, a feed opening. This design has the advantage that the interior of the reactor in the case of repairs, in particular to the coating, can be made easily accessible and inspected.

A further design provides that the slag outlet organ is equipped on its outlet side end with a control dam and in the region between inlet end and outlet end is designed with a gas chamber and with blowing lances arranged therein as a blowing channel. This design has the advantage that the slag outlet organ is connected through via the control dam in a trap-like manner with respect to the gas chamber of the reactor, whereby there results over the length of the slag outlet organ a channel-shaped reactor which is partially filled and with slag, with a gas chamber, whereby blowing lances are arranged such that the slag, during passage therethrough is purified in a manner which removes sulphur, for example by the blowing in of oxygen, wherein the sulphur portion of the slag is burned to sulphur dioxide in an exothermal reaction. For the regulation of the temperature, thereby, for example, water vapor can be mixed in with the oxygen. In order to prevent that damage appears on the incombustible lining due to overheating as a result of the exothermal reaction during combustion of the sulphur, it is provided that the connection region between reactor and slag outlet organ and, where applicable, the slag outlet organ itself is equipped with a water cooling system. It is thereby attained in an advantageous manner that a slag layer solidifies on the cooled wall and forms an autogenous protective layer.

It is finally provided that a granulating container is connected to the outlet-side end of the slag outlet organ.

BRIEF DESCRIPTION OF THE DRAWINGS

Further details, features and advantages result from the embodiment examples which are presented schematically.

DESCRIPTION OF THE PREFERRED EMBODIMENTS

Figure 1:
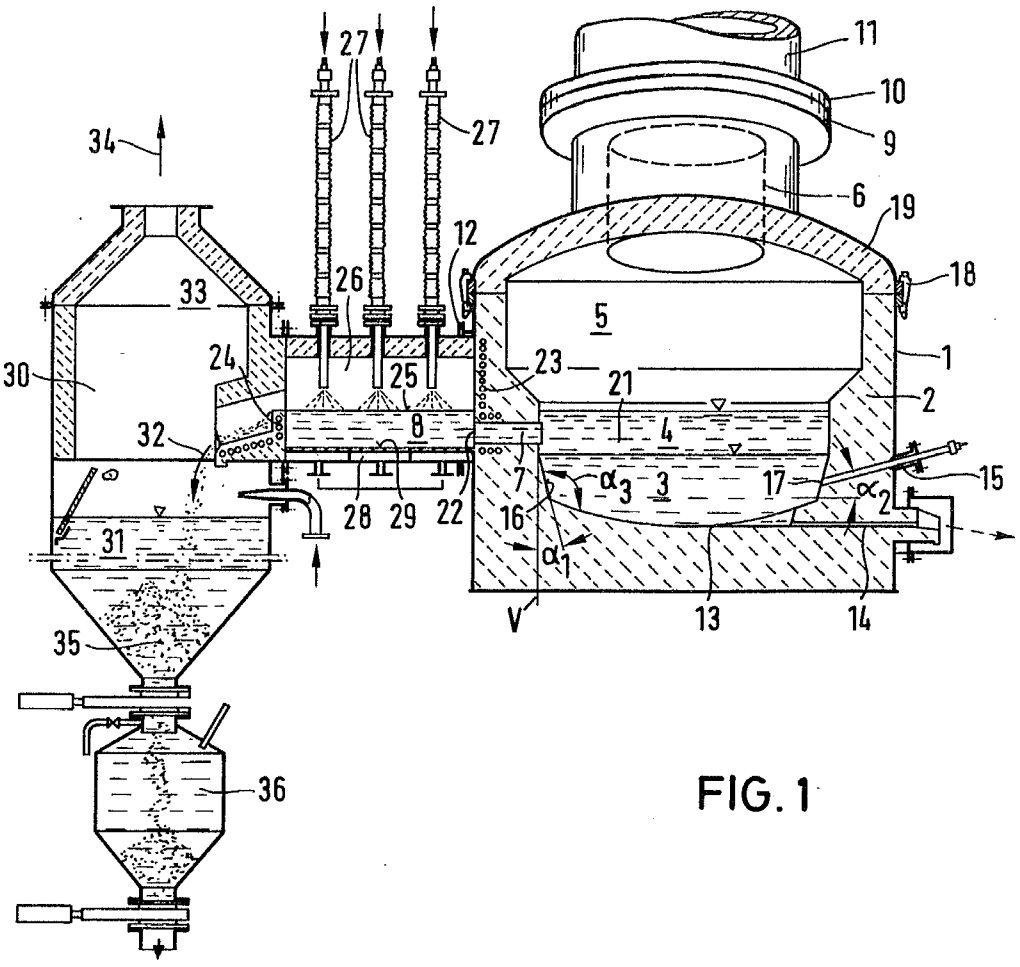
FIG. 1 shows a reactor with a slag outlet organ which is designed as blowing channel and a granulating container which is connected to this in longitudinal section.
Figure 2:
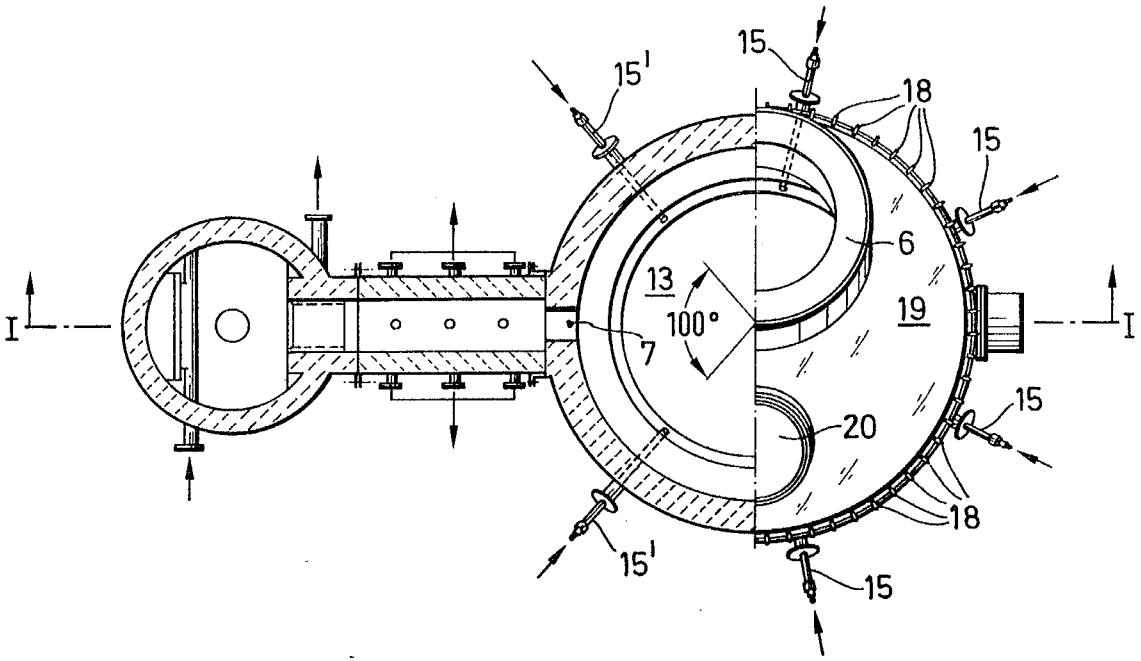
FIG. 2 shows the device according to FIG. 1 in top view, partially in section.

FIG. 1 shows a reactor 1 which is designed as stationary container and is lined in its interior with an incombustible lining 2. The reactor 1, which is shown in cross-section, contains a bath of molten iron 3, and over this a molten slag layer 4. Over this there is located a gas- and/or gas quieting-chamber 5 which is enlarged in cross section, which opens into a gas outlet connecting piece 6. This, for its part, is connected with air-tight connection, for example, by a pair of flanges 9, 10, tightly connected to a gas outlet conduit 11. The left side of the reactor 1 displays a slag outlet opening 7, which is also tightly connected with a connecting flange 12 to an outlet organ 8 for slag. In the region of the reactor floor 13, there is provided an emergency tap channel 14 for molten metal 3, which is hermetically sealed during the operation. Nozzles 15 are arranged in a wall region 16 of the reactor 1 which is close to the floor. These nozzles 15, as can be seen from the cross-sectional presentation in FIG. 2, are arranged symmetrically to a vertical plane I-I which runs centrally both to the slag outlet opening 7 and to the reactor floor 13, at almost the same angle spacing of, in each case 52° on the circumference, while the two nozzles 15' which are arranged closest to the slag outlet opening 7 between them form an angle of approximately 100°. The wall region 16 which is close to the floor and which accepts the nozzles 15, 15' displays an angle $\alpha_1$ with respect to a vertical plane "V". Thereby there results at the interface of this wall region 16 which is close to the floor with the key shaped floor 13 a blunt angle $\alpha_3$, which, as is apparent, makes possible a favorable flow passage of the convective parallel flow of the metal bath 3. The nozzles 15, 15' for their part are set into the wall region 16 which is close to the floor at an angle of $\alpha_2$ with respect to an imagined horizontal plane. Hereby, with the introduction of fuel, aggregates, gasification media and/or protective media there results a downwardly-directed parallel flow at the nozzle opening piece 17. This flow provides, on the one hand the duration of the reaction is prolonged in the iron bath 3, and on the other hand, the focal spot which arises in the vicinity of the reaction is displaced by the parallel flow away from the nozzle end 17 as well as away from the wall region 16 in the direction of the iron bath 3, which has as its result a significant decreasing of nozzle and wall wear and thus improvement of the working time of both the wall 16 and the nozzle opening piece 17. Otherwise, the reactor 1 has a dismantlable cover 19 which is set on tightly with quick assembly units 18, in which are arranged the gas outlet connecting piece 6 and a feed opening 20, which were already mentioned. The dimension of the metal molten bath which is located in the lower reactor region 21 and which contains the molten iron 3 and the molten slag 4, as well as of the gas chamber 5, which is located over this thereover, are determined in the interior of the reactor 1 which displays a circular cross section by differently shaped incombustible linings 2 which are embodied with varying wall thicknesses.

In the connection region 22 between reactor 1 and the slag outlet organ 8 there is arranged a cooling device 23 which is filled with cooling medium, which prevents an overheating of the components at this point. The slag outlet organ 8 is designed as blower channel and is closed off on the outlet side by a dam 24 in such a manner that a liquid level 25 of the slag arises having such a height that hereby a trap-like gas closure is formed with respect to the gas chamber 5 of the reactor 1. Above the slag in the outlet organ 8 is located a gas chamber 26, into which three blowing lances 27 project. The wall of the slag outlet organ 8 is further surrounded with a water jacket 28, which protects the same against over-heating. By the cooling effect, an outer slag layer 29 hardens and forms a natural autogenous protective layer which continuously renews itself. Onto the slag outlet organ 8, at its outlet side, there is connected a granulating tank 30 which is partially filled with a water bath 31. The slag which enters in there and is purified in the blowing channel by combustion of the sulphur portion with oxygen streams, indicated by the arrow 32, is cooled in the water bath suddenly and thereby granulates in a manner which is known per-se. The exhaust gas which contains high amounts of sulphur, which arises by the blowing on of oxidation gases, and, where applicable, of a portion of water vapor, collects in the gas chamber 33 of the granulating vessel 30 and, as is indicated with the arrow 34, is conveyed for the recovery of elementary sulphur, for example according to the Claus process, or also for the production of sulphuric acid, to a corresponding installation which is not depicted. The desulphurized granulated slag is emptied from the floor region 35 of the granulating vessel 30 through a double sluice arrangement 36.

The arrangement specified according to FIG. 1 is depicted in FIG. 2 in cross-section as well as partially in elevation. Thereby, the same functional elements are designated with the same reference symbols.

As already mentioned, from the representation there proceeds the arrangement of the nozzles 15, 15', further the position of the gas outlet connecting piece 6 as well as the feed opening 20 on the cover 19. Further, the representation of the right part of the reactor in a view from above shows the arrangement of the quick assembly devices 18 for the cover 19.

Figure 3:
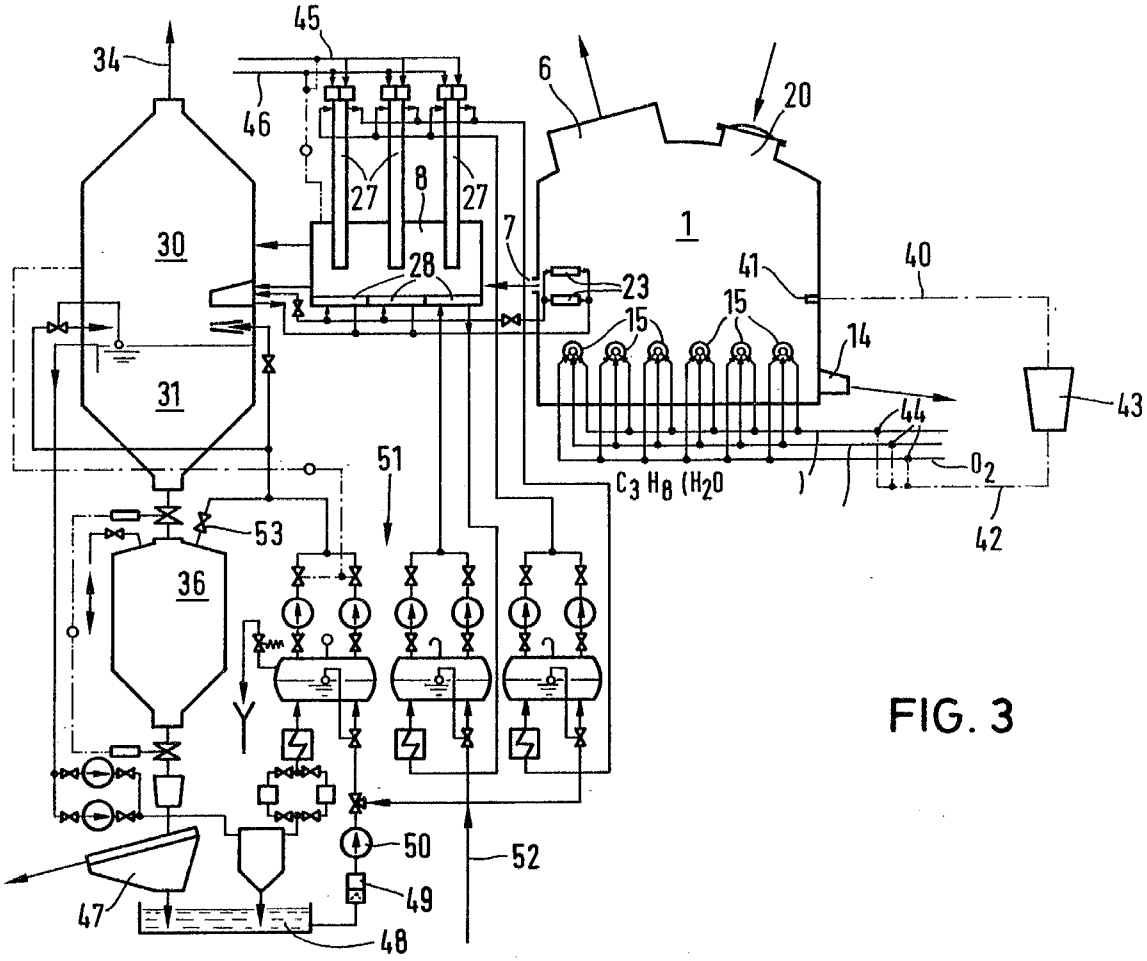
FIG. 3 shows a complete gasification installation with the device according to the invention in block diagram.

The function of the total gasification installation proceeds from the block diagram according to FIG. 3. This shows the reactor 1 with the nozzles 15, the tap 14 and the slag outlet opening 7, and further with the gas outlet connecting piece 6 as well as the feed opening 20. The nozzles 15 are multiple nozzles with three channels, from which the innermost channel is supplied with fuel and carrier gas, a middle channel with oxygen and an outer channel with a buffer gas, for example, $C_3H_8$ in mixture with water vapor. A device for regulation of quantity of the gasification media and auxilliary agents in accordance with the reactor pressure by a regulating device encompasses a pressure receiver 41, control lines 40 and 42, a regulator 43 and the regulating apparatuses 44. The block diagram of FIG. 3 further shows the slag outlet organ 8 designed as blowing channel with the blowing lances 27 and the supply conduits for oxygen 45 and for water vapor 46. The granulating device 30 with the sluice 36 carries the granulated desulphurized slag via a dewatering screen 47 for example, to a slag dump, while recovered water from the collecting tank 48 is fed, after filtration, at 49 by a pump 50 into the water supply network 51.

This obtains fresh water through a fresh water supply conduit 52 and supplies the cooling device 23, as well as the cooling boxes 28, and also the water run off 31 of the granulating vessel 30 and the flooding device 53 of the sluice 36.

The invention is not limited to the embodiments depicted as examples, but rather it lies within the judgment of the person skilled in the art to modify the individual types of embodiments according to posing of the problem and magnitude, or to change them according to structural points of view.

We claim:

1. Apparatus for the gasification of carbon-containing media for the continuous production of a gas essentially containing CO and $H_2$ and a molten bath of iron-containing metal, comprising:

means defining a reaction chamber including a floor, a side wall and a top for holding the bath;

a feed opening communicating with said reaction chamber for supporting a flow of a carbon-containing medium;

a gas outlet in said top communicating with said reaction chamber and connected gas-tight therewith for carrying of the gas;

a liquid slag outlet communicating with said reaction chamber and sealed gas-tight thereto for supporting a flow of a liquid phase; and a plurality of nozzles extending through said side walls for feeding gasification media into said reaction chamber, said nozzles located substantially symmetrical with respect to a vertical plane which extends axially through said reaction chamber and said liquid slag outlet to provide a predetermined bath movement obliquely with respect to the lower portion of said side wall.

2. The apparatus of claim 1, wherein:

said side wall includes a wall portion which extends at an angle $\alpha_1$, with respect to vertical and receives said nozzles therethrough.

3. The apparatus of claim 2, wherein:

said nozzles extend downwardly into said reaction chamber at an angle $\alpha_2$ with respect to horizontal.

4. The apparatus of claim 3, wherein: a respective nozzle is provided for each, 0.5 $m^3$ of bath.

5. The apparatus of claim 1, wherein:

said nozzles are arranged approximately equally spaced from one another and the nozzles nearest to said liquid slag outlet are arranged with an angle of at least 90° therebetween.

6. The apparatus of claim 5, wherein:

each of said nozzles includes an end portion located to be approximately 250 mm from the surface of the bath.

7. The apparatus of claim 5, wherein:

each of said nozzles includes an end portion located to be approximately 250 mm from the surface of the bath and approximately an equal distance from the floor.

8. Apparatus for the gasification of carbon-containing media for the continuous production of a gas essentially containing CO and $H_2$ with a molten bath of iron-containing metal, comprising:

means defining a reaction chamber including a floor, a side wall and a top for holding the bath, said floor and said side wall dimensioned to provide a volume/surface ratio of the bath in the range of 1 $m^{3:1.5-2.5}$ $m^2$;

a feed opening communicating with said reaction chamber for supporting a flow of a carbon-containing medium;

a gas outlet in said top communicating with said reaction chamber and connected gas-tight therewith for carrying of the gas;

a liquid slag outlet communicating with said reaction chamber and sealed gas-tight thereto for supporting a flow of a liquid phase; and a plurality of nozzles extending through said side walls for feeding gasification media into said reaction chamber, said nozzles located substantially symmetrical with respect to a vertical plane which extends axially through said reaction chamber and said liquid slag outlet.

9. Apparatus for the gasification of carbon-containing media for the continuous production of a gas essentially containing CO and $H_2$ with a molten bath of iron-containing metal, comprising:

means defining a reaction chamber including a floor, a side wall and a top for holding the bath, said floor and said side wall dimensioned to provide a volume/surface ratio of the bath in the range of 1 $m^3$:1.8–2.2 $m^2$;

a feed opening communicating with said reaction chamber for supporting a flow of a carbon-containing medium;

a gas outlet in said top communicating with said reaction chamber and connected gas-tight therewith for carrying of the gas;

a liquid slag outlet communicating with said reaction chamber and sealed gas-tight thereto for supporting a flow of a liquid phase; and a plurality of nozzles extending through said side walls for feeding gasification media into said reaction chamber, said nozzles located substantially symmetrical with respect to a vertical plane which extends axially through said reaction chamber and said liquid slag outlet.

10. Apparatus for the gasification of carbon-containing media for the continuous production of a gas essentially containing CO and $H_2$ with a molten bath of iron-containing metal, comprising:

means defining a reaction chamber including a floor, a side wall and a top for holding the bath, said floor and said side wall dimensioned to provide a volume/surface ratio in the range of 1 $m^3$:1.5–2.5 $m^2$;

a feed opening communicating with said reaction chamber for supporting a flow of a carbon-containing medium;

a gas outlet in said top communicating with said reaction chamber and connected gas-tight therewith for carrying of the gas;

a liquid slag outlet communicating with said reaction chamber and sealed gas-tight thereto for supporting a flow of a liquid phase;

a plurality of nozzles extending through said side walls for feeding gasification media into said reaction chamber, said nozzles located substantially symmetrical with respect to a vertical plane which extends axially through said reaction chamber and said liquid slag outlet;

said side wall including a wall portion which extends at an angle $\alpha_1$ with respect to vertical and receives said nozzles therethrough; and said nozzles extending downwardly into said reaction chamber at an angle $\alpha_2$ with respect to horizontal.

11. Apparatus for the gasification of carbon-containing media for the continuous production of a gas essentially containing CO and $H_2$ with a molten bath of iron-containing metal, comprising:

means defining a reaction chamber including a floor, a side wall and a top for holding the bath, said floor and said side wall dimensioned to provide a volume/surface ratio in the range of 1 $m^3$:1.8–2.2 $m^3$;

a feed opening communicating with said reaction chamber for supporting a flow of a carbon-containing medium;

a gas outlet in said top communicating with said reaction chamber and connected gas-tight therewith for carrying of the gas;

a liquid slag outlet communicating with said reaction chamber and sealed gas-tight thereto for supporting a flow of a liquid phase;

a plurality of nozzles extending through said side walls for feeding gasification media into said reaction chamber, said nozzles located substantially symmetrical with respect to a vertical plane which extends axially through said reaction chamber and said liquid slag outlet;

said side wall including a wall portion which extends at an angle $\alpha_1$ with respect to vertical and receives said nozzles therethrough; and said nozzles extending downwardly into said reaction chamber at an angle $\alpha_2$ with respect to horizontal.

* * * * *